US009261849B2

(12) United States Patent
Mizutani et al.

(10) Patent No.: US 9,261,849 B2
(45) Date of Patent: Feb. 16, 2016

(54) TONER CONVEYING DEVICE

(71) Applicant: KYOCERA Document Solutions Inc., Osaka (JP)

(72) Inventors: Naoki Mizutani, Osaka (JP); Koji Murata, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/531,206

(22) Filed: Nov. 3, 2014

(65) Prior Publication Data

US 2015/0125196 A1 May 7, 2015

(30) Foreign Application Priority Data

Nov. 7, 2013 (JP) ..... 2013-231612

(51) Int. Cl.

| | |
|---|---|
| ***G03G 21/10*** | (2006.01) |
| *G03G 21/12* | (2006.01) |
| *G03G 21/00* | (2006.01) |

(52) U.S. Cl.

CPC ..... *G03G 21/105* (2013.01); *G03G 21/0011* (2013.01); *G03G 21/10* (2013.01); *G03G 21/12* (2013.01); *G03G 2221/0005* (2013.01); *G03G 2221/1624* (2013.01)

(58) Field of Classification Search

CPC ..... G03G 21/10
USPC ..... 399/358
See application file for complete search history.

(56) References Cited

U.S. PATENT DOCUMENTS 6,366,755 B1 * 4/2002 Takashima ..... 399/254

FOREIGN PATENT DOCUMENTS

JP 2009-020267 * 1/2009 ..... G03G 15/08

* cited by examiner

*Primary Examiner* — Clayton E Laballe
*Assistant Examiner* — Kevin Butler
(74) *Attorney, Agent, or Firm* — Wenderoth, Lind & Ponack, L.L.P.

(57) ABSTRACT

A toner conveying device includes a common conveyance path, toner input paths and blades. A screw for conveying a toner is installed in the common conveyance path. The toner input paths extend in an up-down direction and have lower ends connected to the common conveyance path. The blades are installed so as to make contact with a shaft of the screw and are configured to scrape off a toner adhering to the shaft of the screw. The blades are arranged immediately below the toner input paths so as to make contact with the shaft of the screw. The blades are disposed at a pitch of an integer multiple of a pitch of the fin of the screw.

5 Claims, 5 Drawing Sheets

TONER CONVEYING DEVICE

CROSS-REFERENCE TO RELATED APPLICATION

This application is based upon and claims the benefit of priority from Japanese Patent Application No. 2013-231612 filed on Nov. 7, 2013, the entire contents of which are incorporated herein by reference.

BACKGROUND

The technology according to one aspect of the present disclosure relates to a toner conveying device.

An image forming apparatus such as, e.g., a laser printer or a multifunction peripheral, includes a toner conveying device that conveys a residual toner removed from an outer circumferential surface of the a photosensitive drum by a cleaning device.

The toner conveying device includes a common conveyance path for conveying a toner to a toner collection container, and a plurality of toner input paths connected to the common conveyance path.

The common conveyance path extends in the horizontal direction. A screw for conveying a toner is installed within the common conveyance path. The screw includes a screw shaft extending along the common conveyance path and a spiral fin one-piece formed with the screw shaft such that the spiral fin is wound around the screw shaft. The toner input paths extend in the up-down direction. The lower ends of the toner input paths are connected to the common conveyance path. The toner conveying device is configured to drop the toner from the toner input paths into the common conveyance path and to convey the toner with the rotating screw.

SUMMARY

A toner conveying device according to one aspect of the present disclosure includes a common conveyance path, toner input paths and blades. A screw for conveying a toner is installed in the common conveyance path. The toner input paths extend in an up-down direction and have lower ends connected to the common conveyance path. The blades are installed so as to make contact with a shaft of the screw and are configured to scrape off a toner adhering to the shaft of the screw. The blades are arranged immediately below the toner input paths so as to make contact with the shaft of the screw. The blades are disposed at a pitch of an integer multiple of a pitch of the fin of the screw.

DETAILED DESCRIPTION

An embodiment of the present disclosure will now be described in detail with reference to the accompanying drawings. The technology of the present disclosure is not limited to the following embodiment.

Figure 1:
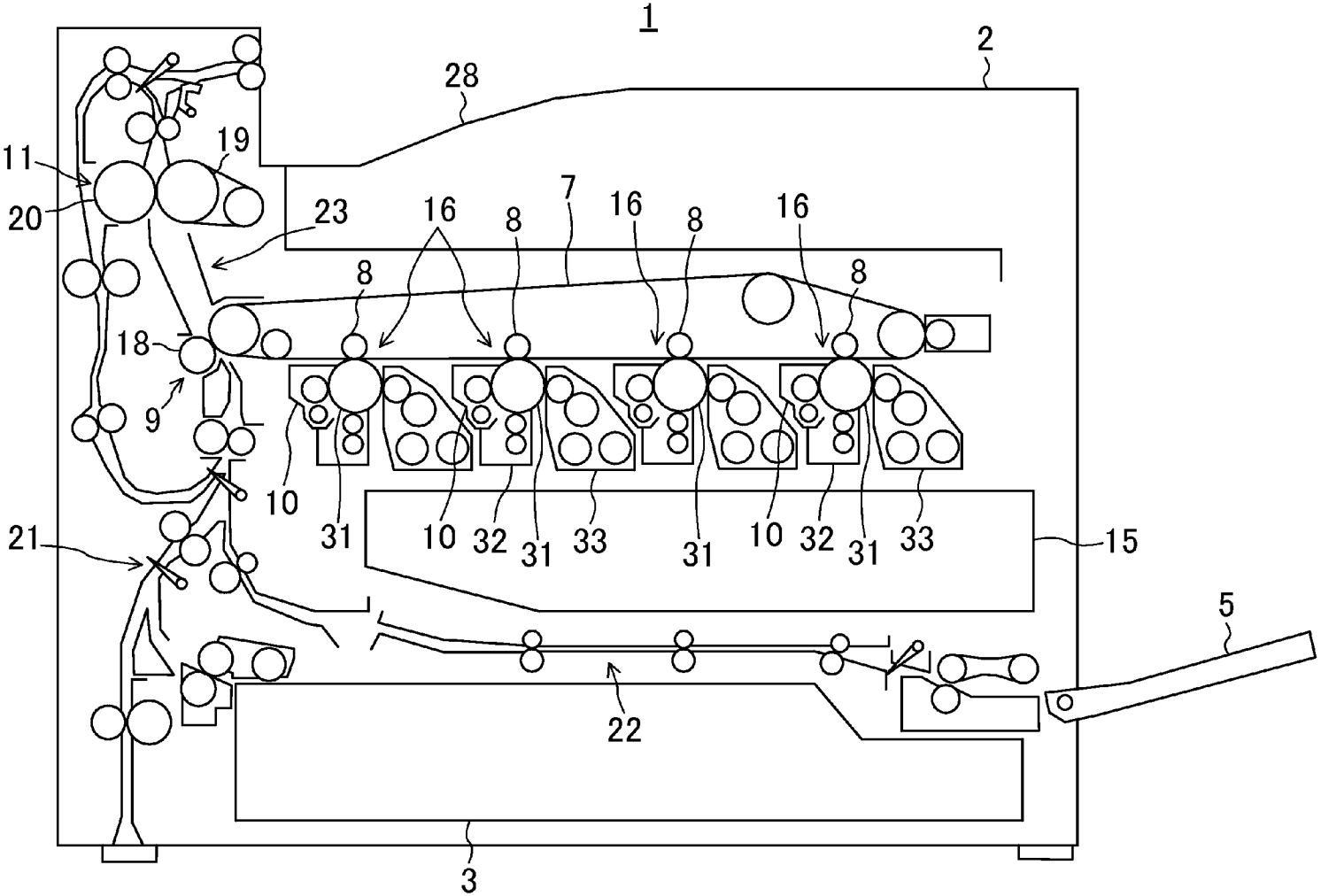
FIG. 1 is a sectional view showing a schematic structure of an image forming apparatus.

FIG. 1 is a sectional view showing a schematic structure of an image forming apparatus 1. The image forming apparatus 1 is, e.g., a tandem-type color printer. As shown in FIG. 1, the image forming apparatus 1 includes an intermediate transfer belt 7, primary transfer units 8, a secondary transfer unit 9, a fixing unit 11, an optical scanner 15, and a plurality of image forming units 16.

A sheet feeding cassette 3 is disposed at the inner lower side of a body 2 of the image forming apparatus 1. The sheet feeding cassette 3 accommodates therein unprinted sheets (not shown) such as cut papers or the like in a stacked state. A first sheet conveying unit 21 is installed at one lateral side of the sheet feeding cassette 3. The first sheet conveying unit 21 receives a sheet sent from the sheet feeding cassette 3 and conveys the sheet toward the secondary transfer unit 9 positioned at the upper side thereof.

A manual sheet feeding unit 5 is installed at the right side of the sheet feeding cassette 3. A second sheet conveying unit 22 is installed at the left side of the manual sheet feeding unit 5. The second sheet conveying unit 22 receives a sheet sent from the manual sheet feeding unit 5 and conveys the sheet toward the first sheet conveying unit 21.

The optical scanner 15 is disposed at the upper side of the second sheet conveying unit 22. Based on the image data received by the image forming apparatus 1, the optical scanner 15 irradiates laser light toward the image forming units 16. The image forming units 16 are installed above the optical scanner 15. An endless intermediate transfer belt 7 is installed above the respective image forming units 16. The intermediate transfer belt 7 is wound around a plurality of rollers and is rotationally driven by a drive device not shown.

As shown in FIG. 1, four image forming units 16 are disposed in one row along the intermediate transfer belt 7. Each of the image forming units 16 forms an image of yellow (Y), magenta (M), cyan (C) or black (K).

Each of the image forming units 16 includes a photosensitive drum 31 as a photosensitive body, a charger 32, a developing device 33 and a cleaning device 10, the latter three of which are disposed around the photosensitive drum 31.

The photosensitive drum 31 is rotationally driven by a drive motor not shown. The charger 32 uniformly charges the outer circumferential surface of the photosensitive drum 31 at a predetermined electric potential using a charging bias voltage applied by a charging bias power supply not shown. Each of the photosensitive drums 31 is configured such that an electrostatic latent image can be formed on the photosensitive drum 31 by writing the light emitted from the optical scanner 15 onto the photosensitive drum 31.

Each of the developing devices 33 accommodates a magenta toner, a cyan toner, a yellow toner or a black toner and develops an electrostatic latent image by affixing the toner to the electrostatic latent image of each of the photosensitive drums 31 on a color-by-color basis, thereby visualizing the electrostatic latent image of each of the photosensitive drums 31 as a toner image.

The primary transfer units 8 are respectively disposed above the respective image forming units 16. The primary transfer units 8 include transfer rollers that primarily transfer the toner images formed by the image forming units 16 to the surface of the intermediate transfer belt 7.

In the meantime, a residual toner or a foreign material such as a byproduct or the like adhere to the outer circumferential surface of the photosensitive drum 31 from which the toner images have been transferred to the intermediate transfer belt 7. The cleaning devices 10 of the image forming units 16 clean the outer circumferential surface of the photosensitive drum 31, thereby removing the residual toner and the foreign material.

The intermediate transfer belt 7 is rotationally driven and the toner images of the respective image forming units 16 are transferred to the intermediate transfer belt 7, whereby a color image composed of the toner images of four colors, i.e., yellow, magenta, cyan and black, which overlap with one another, is formed on the surface of the intermediate transfer belt 7.

As shown in FIG. 1, the secondary transfer unit 9 includes a transfer roller 18 disposed at the left side of the intermediate transfer belt 7. The toner image of the intermediate transfer belt 7 is transferred to the sheet by the transfer roller 18.

The fixing unit 11 is disposed above the secondary transfer unit 9. A third sheet conveying unit 23 for conveying the sheet, to which the toner image has been transferred, toward the fixing unit 11 is disposed between the secondary transfer unit 9 and the fixing unit 11.

The fixing unit 11 includes a fixing roller 19 and a pressing roller 20 which are rotated independently of each other. The sheet is heated and pressed by the fixing roller 19 and the pressing roller 20, whereby the toner image is fixed to the sheet.

As described above, in the image forming apparatus 1, the optical scanner 15 optically scans the photosensitive drums 31 based on the image data. Thus, the electrostatic latent images are formed on the photosensitive drums 31. Thereafter, the electrostatic latent images of the photosensitive drums 31 are developed as the toner images of the respective colors by the developing devices 33. Subsequently, the toner images of the respective colors are transferred from the photosensitive drums 31 to the intermediate transfer belt 7 by the primary transfer units 8. In the secondary transfer unit 9, the toner image of the intermediate transfer belt 7 is transferred to the sheet conveyed from the first sheet conveying unit 21. Thereafter, the sheet to which the toner image is fixed by the fixing unit 11 is discharged toward a sheet discharge part 28.

Figure 2:
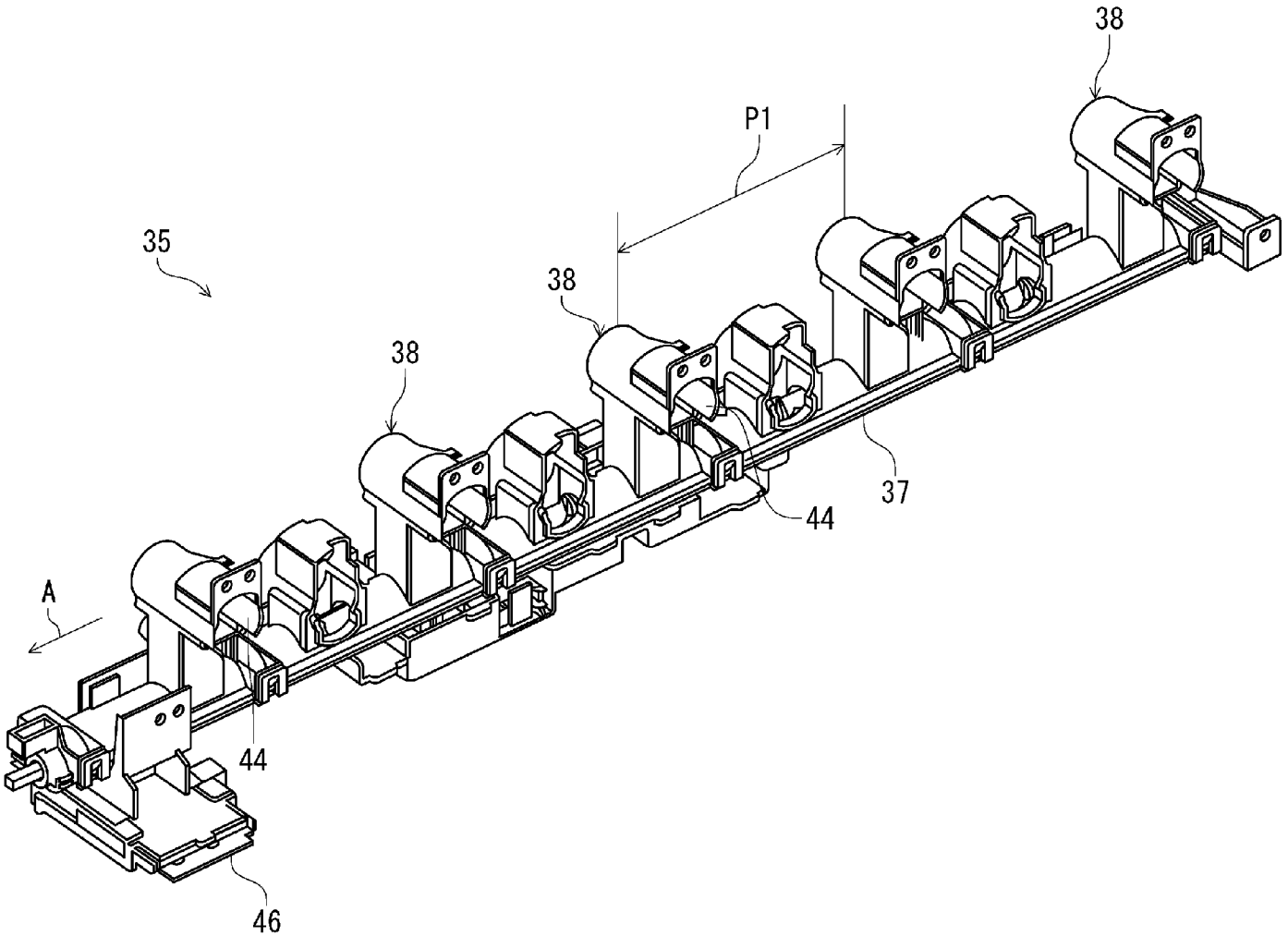
FIG. 2 is a perspective view showing an outward appearance of a toner conveying device.
Figure 3:
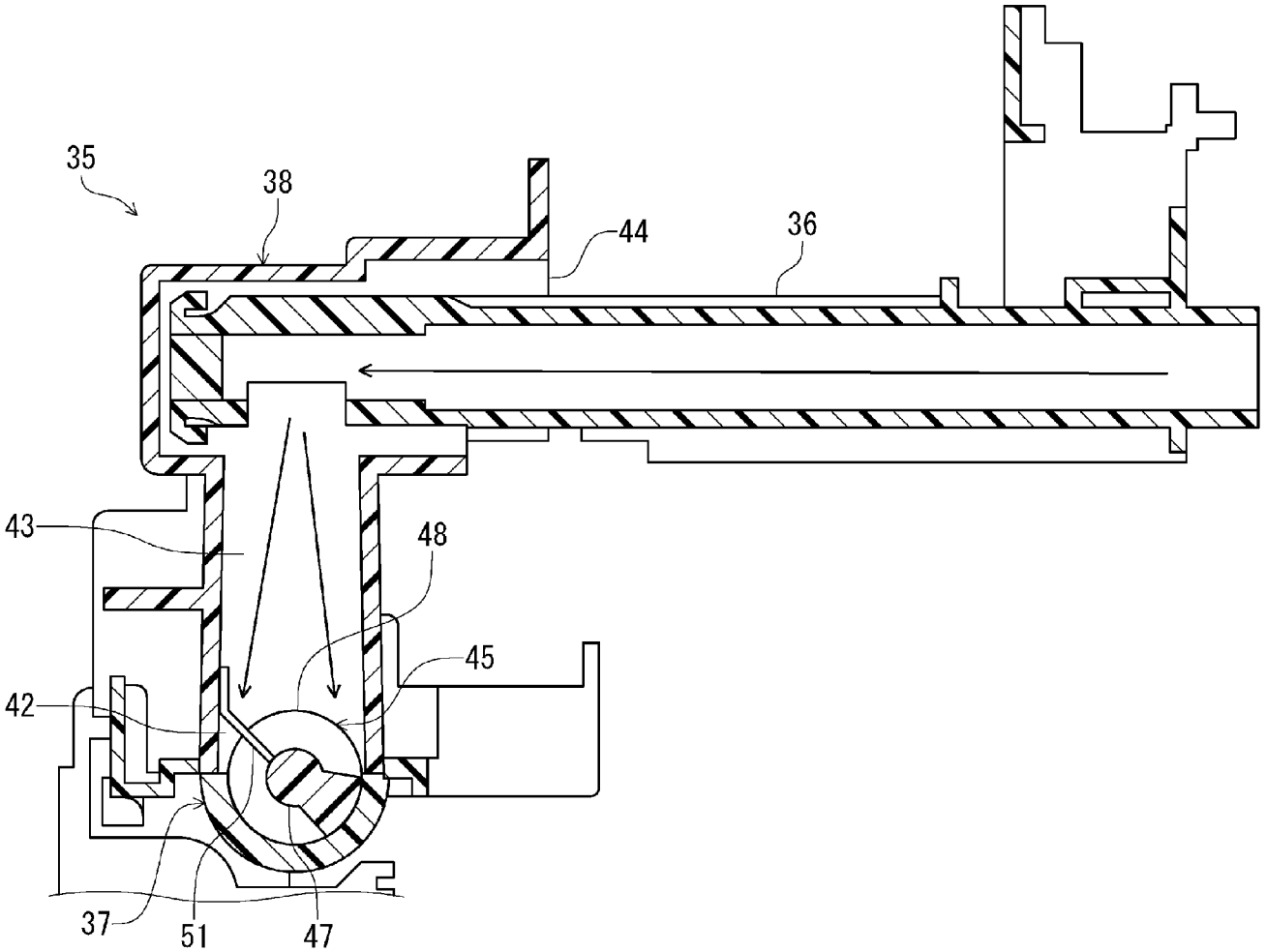
FIG. 3 is a sectional view showing a structure of a toner conveying device connected to a connection pipe.

The image forming apparatus 1 further includes a toner conveying device 35 that conveys the residual toner removed from the outer circumferential surfaces of the photosensitive drums 31 by the cleaning devices 10. FIG. 2 shows the outward appearance of the toner conveying device 35. FIG. 3 shows the cross-sectional structure of the toner conveying device 35 connected to a connection pipe 36.

As shown in FIGS. 2 and 3, the toner conveying device 35 includes a toner conveyance pipe 37 extending in the horizontal direction and a plurality of toner input units 38 connected to the conveyance pipe 37. The toner input units 38 are disposed at a predetermined pitch P1 along the longitudinal direction of the conveyance pipe 37.

The inside of the conveyance pipe 37 constitutes a common conveyance path 42 for conveying a toner to a toner collection container (not shown). A screw 45 for conveying a toner is installed in the common conveyance path 42. A shutter unit 46 for opening and closing the common conveyance path 42 is installed at one end of the common conveyance path 42. As the shutter unit 46 is opened, the common conveyance path 42 communicates with the toner collection container.

Figure 4:
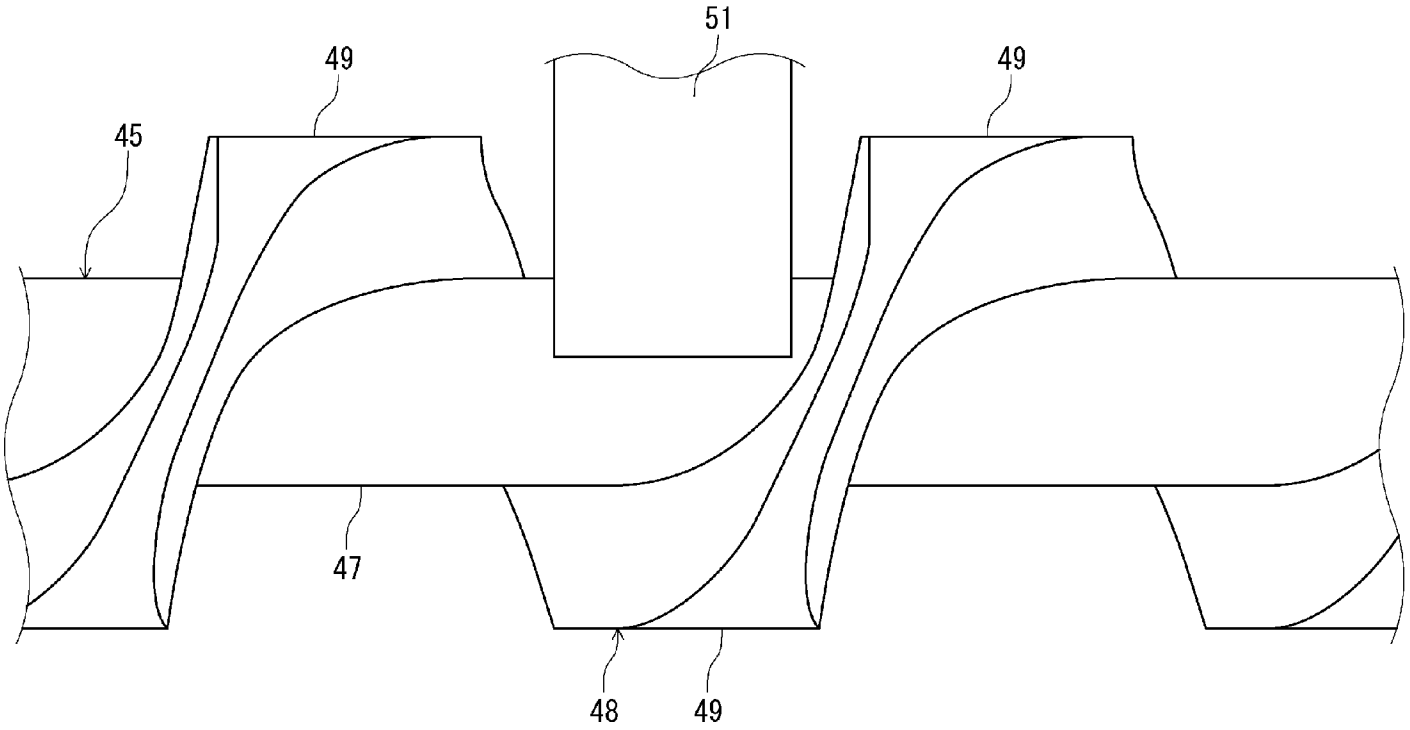
FIG. 4 is an enlarged side view showing a portion of a screw.

FIG. 4 is an enlarged side view showing a portion of the screw 45. As shown in FIGS. 3 and 4, the screw 45 includes a screw shaft 47 extending along the common conveyance path 42 and a spiral fin 48 one-piece formed with the screw shaft 47 such that the spiral fin 48 is wound around the screw shaft 47. The screw 45 is rotationally driven by a drive mechanism (not shown) such as a drive motor or the like and is configured to convey a toner toward the shutter unit 46 (in a conveyance direction A in FIG. 2).

The screw 45 is manufactured by injection molding. The screw 45 has such a shape that, when molds divided into two parts are removed during the manufacture of the screw 45, an undercut is not generated in the fin 48. That is to say, as shown in FIG. 4, the fin 48 includes increased width portions 49 having a relatively large width in the axial direction of the screw 45. The increased width portions 49 are disposed at a predetermined pitch in the axial direction of the screw 45.

As shown in FIGS. 2 and 3, the toner input units 38 include toner input paths 43 extending in the up-down direction and having lower ends connected to the common conveyance path 42, and connection ports 44 kept in communication with the toner input paths 43 and opened toward a lateral side.

The distal ends of connection pipes 46 are connected to the connection ports 44. The base ends of the connection pipes 36 are connected to the cleaning devices 10. The toner is supplied from the cleaning devices 10 to the base ends of the connection pipes 36. That is to say, the toner input paths 43 are connected to the cleaning devices 10 through the connection pipes 36. A screw not shown is installed within each of the connection pipes 36. By the rotation of the screw, the toner supplied from the cleaning devices 10 is conveyed toward the connection ports 44 of the toner input units 38. The toner conveyed to the toner input units 38 freely falls along the toner input paths 43 and enters the common conveyance path 42. The toner existing in the common conveyance path 42 is conveyed toward the shutter unit 46 by the screw 45 as set forth above.

The toner conveying device 35 includes blades 51 for scraping off the toner adhering to the screw 45. The blades 51 are formed of elastic sheets such as, e.g., PET films or the like. The base end portion of the each of the blades 51 is attached and fixed to the inner wall surface of each of the toner input units 38, whereby the blades 51 are fixed in the toner input paths 43. Alternatively, the blades 51 may be fixed to the inner wall surface of the common conveyance path 42. As shown in FIG. 4, the distal end portion of each of the blades 51 extends downward and makes contact with the screw shaft 47. This makes it possible to efficiently scrape off the toner adhering to the screw shaft 47.

Figure 5:
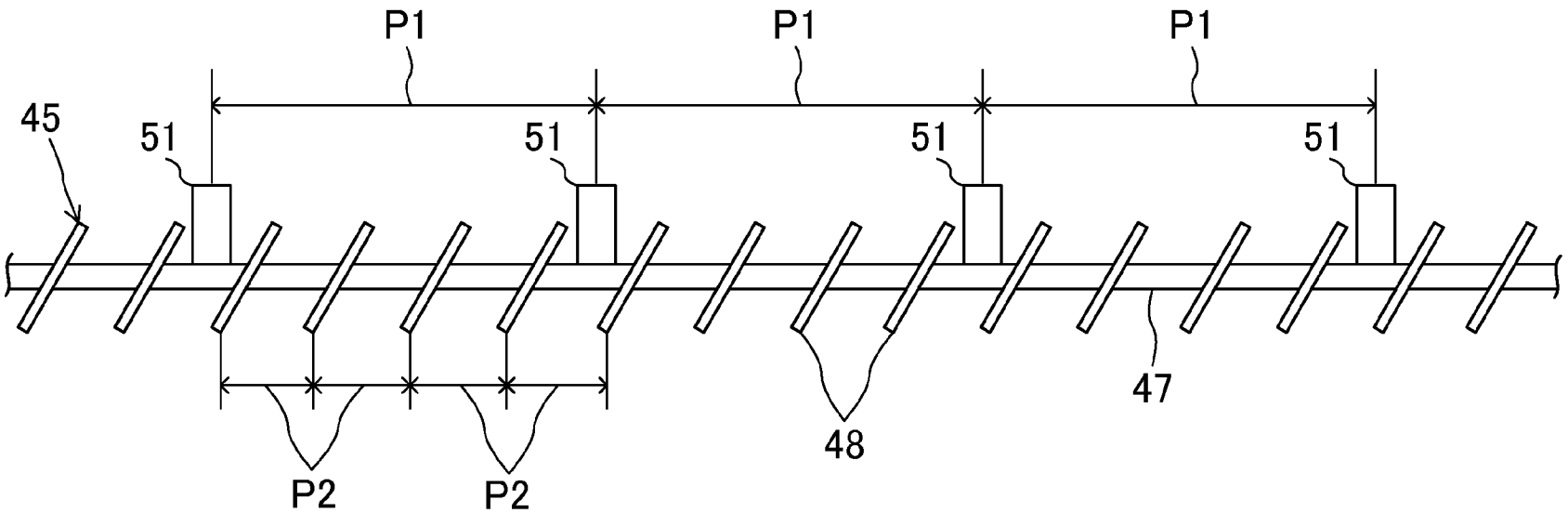
FIG. 5 is a side view schematically showing the relationship between a screw and blades.

FIG. 5 is a side view schematically showing the relationship between the screw 45 and the blades 51. As shown in FIGS. 2 and 5, the blades 51 are disposed at the same pitch as the pitch P1 of the toner input units 38 (namely, the pitch of the toner input paths 43). The blades 51 are respectively disposed immediately below the toner input paths 43. The blades 51 are disposed at a pitch of an integer multiple of the pitch P2 of the fin 48. For example, in the example shown in FIG. 5, the pitch P1 of the blades 51 is four times as large as the pitch P2 of the fin 48.

In a hypothetical case where the blades 51 are not installed, the toner is easy to adhere to the screw shaft 47 in the regions where the toner is inputted (namely, the regions existing immediately below the toner input paths 43). In contrast, in the present embodiment, the blades 51 are disposed so as to make contact with the screw shaft 47 in the regions existing immediately below the toner input paths 43. This makes it possible to efficiently scrape off the toner which tends to adhere to the screw shaft 47.

In the meantime, as shown in FIG. 4, the increased width portions 49 are formed in the fin 48 of the screw 45 at a predetermined pitch in order to prevent generation of an undercut during a molding process. Therefore, the gap between the adjoining roots of the fin 48 becomes narrow near the increased width portions 49. For that reason, in the screw 45 mentioned above, it is difficult to reliably bring all the blades 51 into contact with the screw shaft 47.

In contrast, in the present embodiment, the blades 51 are disposed at the pitch P1 of an integer multiple of the pitch P2 of the fin 48. It is therefore possible to reliably bring all the blades 51 into contact with the screw shaft 47.

That is to say, according to the present embodiment, all the blades 51 can be reliably brought into contact with the screw shaft 47 in the regions existing immediately below the toner input paths 43 where the toner is easy to adhere to the screw shaft 47. It is therefore possible to appropriately suppress adherence of the toner to the screw shaft 47. As a result, the toner conveyance ability of the toner conveying device 35 can be kept high. In a high temperature environment or a high humidity environment, the adherence of the toner to the screw shaft 47 becomes a great problem. According to the toner conveying device 35 described above, it is possible to appropriately maintain the toner conveyance ability even in the high temperature environment or the high humidity environment.

In the aforementioned embodiment, the color printer has been described as one example of the image forming apparatus. However, the image forming apparatus is not limited to the color printer. The image forming apparatus may be, e.g., a copier, a scanner, a multifunction peripheral or other image forming apparatuses.

As described above, the technology of the present disclosure is useful in the toner conveying device and the image forming apparatus provided with the toner conveying device.

What is claimed is:

1. A toner conveying device, comprising:

a common conveyance path in which a screw for conveying a toner is installed;

a plurality of toner input paths extending in an up-down direction and having lower ends connected to the common conveyance path; and a plurality of blades installed so as to make contact with a shaft of the screw and configured to scrape off a toner adhering to the shaft of the screw, wherein the blades are arranged immediately below the toner input paths and are disposed between increased width portions formed in a fin of the screw, the blades disposed at a pitch of an integer multiple of a pitch of the fin of the screw.

2. The device of claim 1, wherein the blades are disposed immediately below the toner input paths so as to make contact with the shaft of the screw.

3. The device of claim 1, wherein the screw includes a spiral fin one-piece formed with the shaft of the screw, the fin including increased width portions having an increased width in an axial direction of the screw, the increased width portions disposed at a predetermined pitch.

4. The device of claim 1, wherein each of the blades includes a base end portion fixed to an inner wall surface of each of the toner input paths or an inner wall surface of the common conveyance path and a distal end portion extending downward.

5. The device of claim 1, wherein the toner input paths are connected to cleaning devices of a tandem-type color image forming apparatus.

* * * * *